United States Patent [19]

Lazaridis et al.

[11] 4,202,661

[45] May 13, 1980

[54] JET IMPLEMENT RADIATION FURNACE, METHOD AND APPARATUS

[75] Inventors: Lazaros J. Lazaridis, Lincoln; Gabor Miskolczy, Carlisle, both of Mass.; Paul K. Shefsiek, Farmington, Mich.

[73] Assignee: Thermo Electron Corporation, Waltham, Mass.

[21] Appl. No.: 11,981

[22] Filed: Feb. 14, 1979

Related U.S. Application Data

[63] Continuation of Ser. No. 882,166, Mar. 1, 1978, abandoned, which is a continuation of Ser. No. 751,410, Dec. 16, 1976, abandoned.

[51] Int. Cl.[2] ..... F27B 9/02

[52] U.S. Cl. ..... 432/8; 432/136; 432/147; 432/175; 432/192; 266/103; 266/111

[58] Field of Search ..... 432/136, 146, 147, 175, 432/192, 8, 11; 266/103, 111

[56] References Cited

U.S. PATENT DOCUMENTS

| | | | |
|---|---|---|---|
| 1,709,526 | 4/1929 | Dumbleton | 432/175 |
| 2,673,728 | 3/1954 | Grosskloss | 432/175 |
| 3,150,864 | 9/1964 | Fetner et al. | 432/8 |

*Primary Examiner*—Larry I. Schwartz

*Attorney, Agent, or Firm*—Herbert E. Messenger; James L. Neal

[57] ABSTRACT

A furnace for heat treating metal slabs or strips includes a heating chamber through which stock is passed in confronting relationship to an array of jet impingement radiation burners. Combustion is separated from the stock by flat refractory plates having a plurality of holes uniformly distributed thereover which direct uniform jets of combustion products upon the strip or slab. The jets of combustion products heat the work by convection. Also, the refractory jet forming plates are heated to radiance so that heat energy is transferred to the work by radiation.

8 Claims, 3 Drawing Figures

JET IMPLEMENT RADIATION FURNACE, METHOD AND APPARATUS

This is a continuation of application Ser. No. 882,166, filed Mar. 1, 1978, now abandoned, which is a continuation of application Ser. No. 751,410, filed Dec. 16, 1976, now abandoned.

BACKGROUND OF THE INVENTION

Annealing furnaces tend to be highly inefficient in that a large quantity of heat energy generated by combustion of fuel is lost without being transferred to the work. For example, many slab reheat and annealing furnaces have placed emphasis principally on the heat transfer by radiation and the furnace geometry, the type of refractory surfaces used and the combustion techniques involved tend to make radiant heat transfer dominant. There is, accordingly, a significant convective contribution from the products of combustion which is lost. Additionally, annealing furnaces are frequently large and involve a considerable thermal inertia, slow temperature response and difficulty in handling transfer of the work. Most frequently work is held in the unit for a period of time during which it is raised to the treating temperature.

It is accordingly a general object of this invention to produce a furnace for heating, annealing or heat treating flat metal slabs or strips which is highly efficient and therefore results in economical use of fuel.

It is a further object of this invention to provide a heat treating furnace for metal stock which transfers heat to the metal stock both by convection and radiation under circumstances where both the convective contribution and the radiant contribution are substantial.

It is also an object of this invention to provide a method of heating metal stock by directing jets of combustin products onto the metal stock through a heat radiating refractory plate.

It is an additional object of the present invention to provide a method of heat treating metal stock which comprises continuously advancing the stock through an elongated combustion chamber and directing turbulent jets of combustion products onto the stock, while subjecting the stock to radiation from a perforated refractory plate through which the jets are formed.

SUMMARY OF THE INVENTION

In accordance with the present invention, an improved furnace is provided for heating flat metal strips, sheets and slabs. For purposes of this patent application, the word "strip" shall include flat strips, slabs, sheets and the like. An elongated furnace chamber receives continuously advancing strip stock. The surface of the stock is confronted by a furnace wall which includes an array of refractory plates having openings of like size uniformly distributed thereover. The plates separate the sheet stock from forced combustion means in which a combustion mixture is essentially completely burned. Combustion occurs on the side of the plates opposite the sheet stock and combustion products are forced through the openings in the plates to form uniform jets. The pressure drop across the plates is sufficient to produce turbulent jets and the combustion temperature is at a level sufficient to heat the jet forming plates to radiance. The plates seal the combustion chamber from the furnace chamber so that combustion products formed in the combustion chamber can enter the furnace chamber only through the jet forming openings.

Flat metal strip stock is advanced through the furnace during operation so that the surface of the stock being treated is displaced from the confronting surfaces of the jet forming plates to locate the surface being treated in the zone of maximum turbulence. Preferably, the metal strip stock is displaced from the aforesaid confronting surface by a distance which exceeds the diameter of the jet forming openings by a factor of at least 10 but not more than 15. Also, jet flow is preferably characterized by a Reynolds number equalling or exceeding approximately 2000.

DETAILED DESCRIPTION OF THE DRAWINGS

Figure 1:
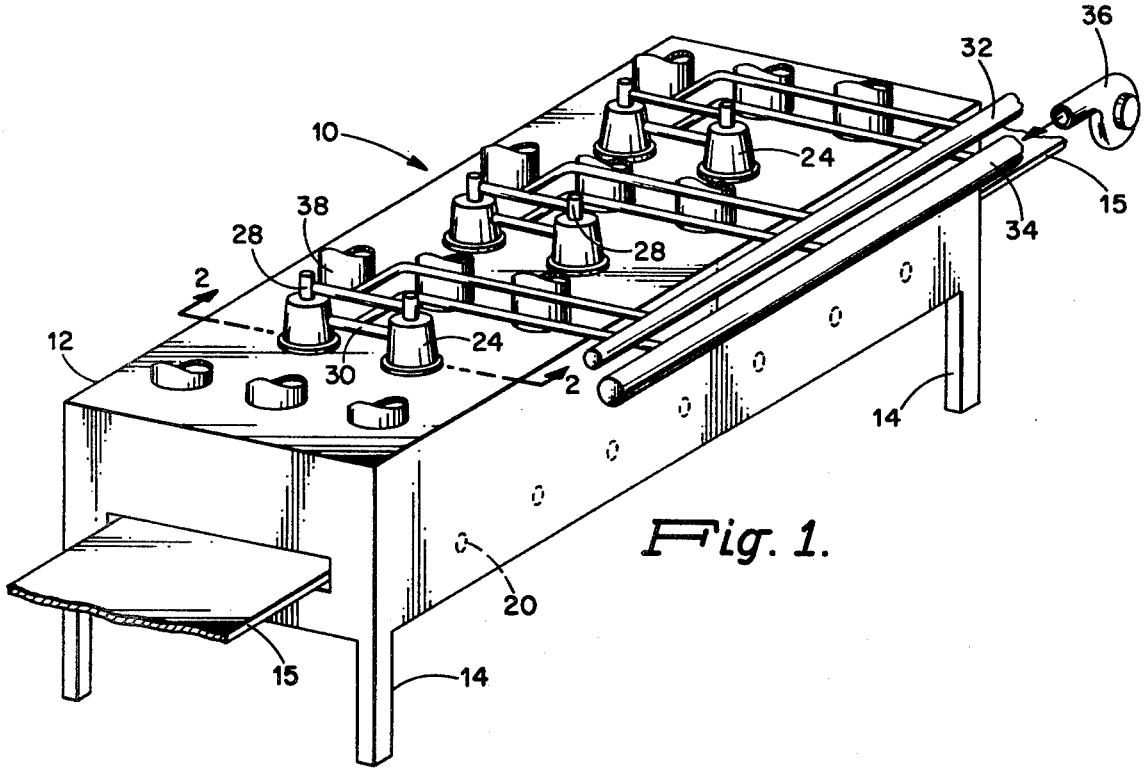
FIG. 1 is a perspective view illustrating a jet impingement radiation furnace constructed in accordance with the present invention.
Figure 2:
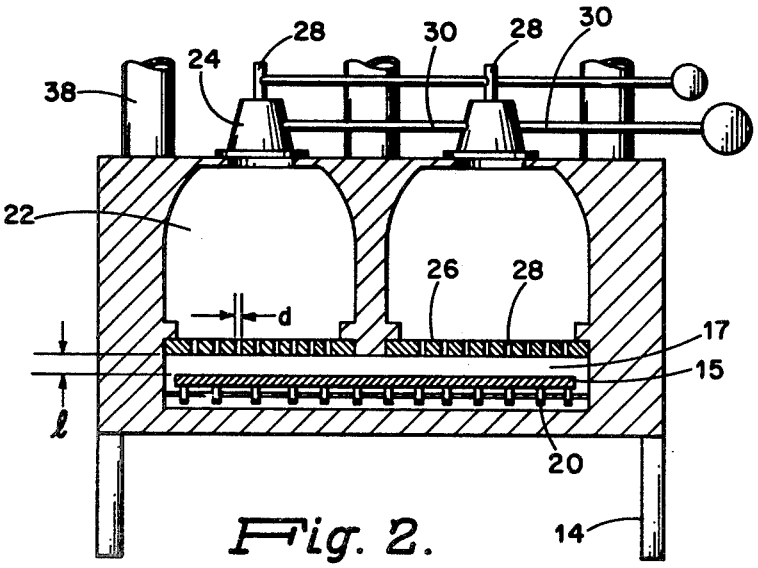
FIG. 2 is a sectional view of the apparatus of the apparatus of FIG. 1 showing the jet impingement radiation burner associated with the apparatus of FIG. 1.

Referring to FIGS. 1 and 2, the furnace 10 includes a housing 12 supported upon a base means 14. With the housing 12 is an elongated furnace chamber 17 through which flat strip stock 15 is continuously advanced. Mounted within the furnace chamber 17 are a series of stock transporting roller means 20. The roller means 20 supports the stock within the furnace chamber 17 and permits it to move continuously therethrough.

Positioned above the furnace chamber 17 for fluid communication therewith is combustion chamber means including a plurality of combustion chambers 22, each combustion chamber being associated with a burner means 24. The combustion chambers are separated from the furnace chamber 17 by an array of perforated refractory plates 26. Each plate covers the opening between a combustion chamber 22 and the furnace chamber 17. The lower surface, or floor, of the combustion chamber incorporates an array of the plates 26 which are typically positioned closely adjacent each other and arranged in parallel rows so that they cover substantially all of the aforesaid upper surface of the combustion chamber. The plates are situated in a common plane confronting the stock 15, in a plane parallel to the confronting stock surface.

Figure 3:
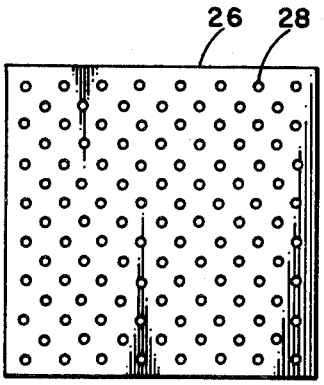
FIG. 3 is a plan view illustrating the jet forming plate shown in FIG. 2.

A plan view of a plate 26 is illustrated in FIG. 3. The plate 26 includes a plurality of like apertures or openings, 28 distributed evenly thereacross. The exact configuration and spacing of the openings can be varied, within limits, for each particular application. However, for most applications, the diameter of individual openings will be between 1/16 inch (0.16 cm) and $\frac{5}{8}$ inch (1.59 cm) and the aggregate open area defined by all the openings in a plate will not exceed 10% of the plate area. In the particular embodiment illustrated in FIG. 3, one hundred thirteen openings 0.25 inches (0.64 cm) in diameter extend through a square plate having an area of one square foot (0.093 $m^2$). The openings extend perpendicularly through the plates, in staggered rows approximately 0.7 inches (1.78 cm) apart and define an aggregate open area which is approximately 3.85% of the surface area of the plate.

Each burner means 24 includes a fuel inlet 28 and a combustion air inlet 30. The fuel inlets 28 communicate with the common fuel manifold 32 and the combustion air inlets 30 communicate with a common manifold 34. The manifold 34 is connected to a blower means 36. Gas supplied through the manifold 32 and air supplied through the manifold 34 provide a combustible mixture in the combustion chamber 22. The blower means serves to force the combustible mixture into the combustion chamber 22 and to drive combustion products through the furnace chamber 17. The force applied to the combustion system by the blower means 36 is effective to create uniform, discrete jets through the openings 28 in the plates 26. Flues 38 extend upward from the furnace chamber 17 to exhaust combustion products. The restricted open area in the perforated plates 26 enables the forced combustion system to be operated so that essentially complete combustion occurs within the combustion chamber 22. Thus, only products of combustion may pass through the openings 28, avoiding combustion within the furnace chamber 17.

The relationship between the perforated plate 26 and the stock 15 will now be more particularly described. Let the diameter of each opening 28 be designated "d" and the distance between confronting surfaces of the work 15 and the plate 26 be designated "l", as indicated in FIG. 2. The preferred relationship between the plate and the work can then be defined in terms of physical dimensions and a characteristic Reynolds number. The expression for the Reynolds number is as follows:

$$Re = Velocity \times Diameter / Viscosity$$

Where:

(1) "Velocity" is the velocity of flow through the opening 26;

(2) "Diameter" is the diameter of a single opening; and (3) "Viscosity" is the viscosity of the combustion products passing through the openings.

Highly efficient performance is obtained when the Reynolds number equals or exceeds approximately 2000 and the ratio, l/d, falls within a range not less than 10 or in excess of 15. Under these conditions, jets of combustion products issuing through the openings 28 will exhibit laminar flow for a short displacement from the plate 26 and then revert to an intense turbulent flow. The zone of intense turbulent flow coincides with the position of the surface of the stock 15 to be heated. The stock surface thus experiences the forceful impingement of the jet of combustion products and also the internal turbulencewithin the jet.

A chief advantage of the furnace constructed according to this invention resides in dual source heat transfer. In addition to the effective convective heat transfer described above, the stock 15 experiences a major radiative heat transfer component. The plate 26 is constructed of a suitable refractory material (e.g., silicone carbide or alloy steel) which is heated by combustion products from the combustion chamber 22. The temperature of combustion products issuing through the openings 28 is sufficient to maintain the plate 26 at a temperature of at least 1200° F. Preferably the plate is heated to a temperature in the range 1500° F. to 2000° F., the practical temperature range extending to approximately 2400° F. Within these temperature ranges, the radiative component of total heat transfer is a major one and does not substantially detract from the convective component. In the 1500° F. to 2000° F. range, the contributions of the radiative components and the convective components are substantially equal. Correspondingly, under typical conditions, at 1200° F. the convective component is somewhat larger than the radiative component and, at 2400° F., the radiative component exceeds the convective component. Considering materials which are commonly available, a plate 26 of alloy steel is suitable for use at temperatures up to about 1500° F. For higher temperatures a ceramic plate is preferred. Under some conditions the plate 26 may incandesce although this is not a requisite for efficient operation.

In operation, the stock 15 is continuously advanced through the furnace chamber 17 so that is passes beneath the array of perforated plates 26. The surface of the stock to be heated is maintained in position to establish the desired l/d ratio within the furnace chamber by the rollers means 20. The furnace will accept a continuous strip of material or a series of separate sheets or plates. The spacing, position and type of rollers used will be determined by the stock to be treated. As the stock is advanced through the furnace chamber 17, a combustible mixture is fed through the fuel inlets 28 and the air inlets 30 to the burners 24 and complete combustion occurs in the chambers 22. The blower means 36 produces a pressure drop across the plates 26, as a result of the pressure drop across the plates, discrete uniform jets of combustion products issue through the openings 28 and impinge upon the stock, as described above. Heat transfer to the stock occurs both by convection resulting from impingement of the jets and by radiation from the plate 26. The stock is discharged from the furnace chamber 17, through the end thereof opposite the entry.

Since certain changes may be made in the apparatus and method described above without departing from the scope of the invention, it is intended that all matter contained therein or shown in the drawings be interpreted as illustrative and not in a limiting sense.

We claim:

1. The method of heating flat strip stock comprising the steps of:

supporting the stock in a furnace chamber below combustion chamber means and separated therefrom by an array of flat refractory plates lying in a common plane, said plates having a plurality of apertures therethrough of substantially equal size perpendicular to said common plane and distributed substantially evenly across said plates;

producing essentially complete combustion in the combustion chamber means for heating the array of plates to radiance at a temperature above approximately 1200° F.;

directing a flow of combustion products from said combustion chamber means through the apertures in the plates as uniform, discrete jets;

producing a pressure drop across said plates of sufficient magnitude that the jets are turbulent after emerging from the apertures in the plates;

positioning the stock in the furnace chamber such that a horizontal surface thereof confronts the plates, said horizontal surface being positioned in the zone of maximum turbulence of said jets; and continuously advancing the flat strip stock through the furnace chamber whereby said stock is heated simultaneously by convection from direct contact with said turbulent jets and by radiation from said plates, said convection and said radiation each contributing a substantial fraction of the total heat transferred to the stock.

2. The method of claim 1 wherein said combustion producing step comprises the step of producing essentially complete combustion for heating the array of plates to radiance at a temperature in the range of 1500° F. to 2000° F. and wherein the heat transfer contributions of said turbulent jets and said radiation are substantially equal.

3. The method of claim 1 wherein the flow of combustion products through said apertures is characterized by a Reynolds number not less than 2000.

4. The method of claim 3 wherein said horizontal surface of the stock to be heated is positioned in a plane displaced from the confronting surfaces of the plates by a distance which exceeds the diameter of individual apertures in the plates by a factor of not less than 10 or more than 15.

5. The method of claim 1 wherein said horizontal surface of the stock to be heated is positioned in a plane displaced from the confronting surfaces of the plates by a distance which exceeds the diameter of individual apertures in the plates by a factor of not less than 10 or more than 15.

6. A furnace for heating; metal stock comprising:

an elongated furnace chamber for receiving stock to be heated, said stock having a substantially planar surface;

means for continuously advancing the stock through said chamber;

an array of combustion chambers positioned above said furnace chamber for directing products of combustion thereinto;

a flat, heat radiative plate interposed between each said combustion chamber and said furnace chamber, said plates lying in a common plane confronting the flat surface of the stock to be heated and having a plurality of openings perpendicularly therethrough, the openings being of substantially equal size and evenly distributed over the surface of said plates, said plates positioned closely adjacent each other for sealing said combustion chambers from said furnace chamber so products of combustion enter said furnace chamber from said combustion chambers only through said openings;

forced combustion means associated with said combustion chambers for producing essentially complete combustion within said combustion chambers and for producing a pressure drop across each said plate sufficient to expel turbulent jets of combustion products therefrom through said openings; and means for supporting the stock to be heated within said furnace chamber so that the upper planar surface of such stock will be in the zone of maximum turbulence of the jets of combustion products issuing from said openings and will be heated by convection from direct contact with said jets and by radiation from said plates in a manner such that both the convective and radiant contributions are substantial.

7. The furnace of claim 6 wherein said supporting means positions said surface to be heated in a plane displaced from the confronting surfaces of said array of plates by a distance which exceeds the diameter of individual openings in said plates by a factor of not less than 10 or more than 15.

8. The furnace of claim 7 wherein said forced combustion means comprises a combustion system for heating said heat radiative plate to a temperature in the range of 1200° F. to 2400° F. and for producing jets of combustion products characterized by a Reynolds number not substantially less than 2000.

* * * * *

UNITED STATES PATENT AND TRADEMARK OFFICE

CERTIFICATE OF CORRECTION

PATENT NO. : 4,202,661
DATED : May 13, 1980
INVENTOR(S) : Lazaros J. Lazaridis, Gabor Miskolczy & Paul K. Shefsiek It is certified that error appears in the above—identified patent and that said Letters Patent is hereby corrected as shown below:

On the title page, after "[54] Jet", delete "Implement" and substitute --Impingement--.

On the title page, after "[22] Filed: Feb. 14, 1979", add --[30] Foreign Application Priority Data
Dec. 6, 1976 [UK] United Kingdom 50788/76--.

In the Specification:

At column 1, lines 38-39, delete "combustin" and replace with --combustion--.

At column 2, line 29, delete "With" and replace with --Within--.

At column 2, line 48, after "aforesaid" delete "upper" and replace with --lower--.

At column 5, line 25, after "heating", delete ";".

Signed and Sealed this

*Thirtieth* Day of *September 198*

[SEAL]

*Attest:*

SIDNEY A. DIAMOND

*Attesting Officer*

*Commissioner of Patents and Trademar*